US010105273B1

(12) United States Patent
Granone

(10) Patent No.: US 10,105,273 B1
(45) Date of Patent: Oct. 23, 2018

(54) PORTABLE THERAPY TABLE

(71) Applicant: John Granone, New Port Richey, FL (US)

(72) Inventor: John Granone, New Port Richey, FL (US)

( * ) Notice: Subject to any disclaimer, the term of this patent is extended or adjusted under 35 U.S.C. 154(b) by 20 days.

(21) Appl. No.: 15/853,601

(22) Filed: Dec. 22, 2017

(51) Int. Cl.
*A61G 13/10* (2006.01)
*A61G 13/00* (2006.01)
*A61H 1/02* (2006.01)
*A47B 3/087* (2006.01)

(52) U.S. Cl.
CPC ..... *A61G 13/105* (2013.01); *A61G 13/009* (2013.01); *A61H 1/0292* (2013.01); *A47B 3/087* (2013.01); *A61H 1/0274* (2013.01); *A61H 2201/0161* (2013.01)

(58) Field of Classification Search
CPC ..... A61G 7/002; A61G 7/005; A61G 7/012; A61G 7/015; A61G 7/018; A61G 13/02; A61G 13/04; A61G 13/06; A61G 13/08; A61G 13/009; A61G 13/105; A61H 1/008; A61H 1/0218; A61H 1/0222; A61H 1/0292
USPC ..... 5/620, 600, 610, 611, 613, 616–618; 606/237, 241, 242, 245
See application file for complete search history.

(56) References Cited

U.S. PATENT DOCUMENTS 1,194,112 A * 8/1916 Wood et al. ..... A47C 20/026 5/613
1,908,778 A * 5/1933 Memminger ..... A61G 13/105 606/245
2,236,770 A * 4/1941 Atwell ..... A61G 13/105 5/613
2,517,681 A * 8/1950 Koerper ..... A61G 13/105 108/166
2,579,783 A * 12/1951 Branto ..... A61G 13/105 5/617
2,965,425 A * 12/1960 Grinsell ..... A61G 13/105 5/619
4,333,638 A * 6/1982 Gillotti ..... A47B 3/087 108/36
4,850,343 A * 7/1989 Scott ..... A61G 13/009 606/245
4,856,497 A * 8/1989 Westphal ..... A47B 3/087 606/242

(Continued)

*Primary Examiner* — Robert G Santos
(74) *Attorney, Agent, or Firm* — Gulf Coast Intellectual Property Group

(57) ABSTRACT

A portable therapy table configured to have a folded position and a deployed position wherein the portable therapy table is operable to facilitate a downward movement for a user superposed thereon. The portable therapy table includes a frame having a first portion and a second portion hingedly coupled. A user support surface is superposed the frame. The frame includes an extendable engagement member extending outward therefrom wherein the extendable engagement member includes a telescopic lower section and an upper section perpendicular thereto. The frame is support by foldable forward leg members and a rear leg member. The rear leg member is configured similarly to a piston so as to provide the desired movement of the second portion of the frame. Actuators are mounted to the upper section of the extendable engagement member and are operably coupled to a controller wherein the controller facilitates movement of the rear leg member.

13 Claims, 4 Drawing Sheets

(56) References Cited

U.S. PATENT DOCUMENTS

| | | | | | |
|---|---|---|---|---|---|
| 4,943,041 | A * | 7/1990 | Romein | A47B 3/083 | 108/36 |
| 5,423,861 | A * | 6/1995 | Kelley | A61G 13/009 | 248/615 |
| 6,615,431 | B2 * | 9/2003 | Lin | A61G 13/009 | 5/600 |
| 6,679,905 | B2 * | 1/2004 | Peetros | A61G 13/009 | 606/241 |
| 6,684,426 | B1 * | 2/2004 | Lin | A47B 3/087 | 108/132 |
| 7,381,214 | B1 * | 6/2008 | Pruett | A61G 13/009 | 5/611 |
| 7,610,863 | B1 * | 11/2009 | Smith-Huebner | A47B 3/091 | 108/36 |
| 8,555,437 | B2 * | 10/2013 | Gorovitz | A61G 13/009 | 5/613 |
| 2002/0120293 | A1 * | 8/2002 | Peetros | A61G 13/009 | 606/241 |
| 2003/0088919 | A1 * | 5/2003 | Lin | A61G 13/009 | 5/620 |
| 2007/0251010 | A1 * | 11/2007 | Lara | A61G 13/009 | 5/620 |
| 2008/0083068 | A1 * | 4/2008 | Roleder | A47C 7/54 | 5/646 |
| 2009/0288017 | A1 * | 11/2009 | Just | A61G 13/10 | 715/750 |
| 2010/0299835 | A1 * | 12/2010 | Andrews | A61G 13/009 | 5/620 |
| 2011/0047705 | A1 * | 3/2011 | Gorovitz | A61G 13/009 | 5/613 |
| 2013/0283526 | A1 * | 10/2013 | Gagliardi | A61G 13/0009 | 5/421 |

* cited by examiner

PORTABLE THERAPY TABLE

FIELD OF THE INVENTION

The present invention relates generally to a therapy table, more specifically but not by way of limitation, a table that can be utilized for exercise and back therapy that is portable wherein the table of the present invention facilitates treatment and exercise routines for the user's back.

BACKGROUND

Millions of people suffer with back problems such as but not limited to lower back pain. Most commonly mechanical issue and soft tissue damage are the cause of back pain. These injuries can include but are not limited to damage to the intervertebral discs, improper movement of the spinal joints and compression of nerve roots. Numerous alternate types of therapies exist to handle back pain and other back issues. The home health care industry for back care products is approximately thirteen to fifteen billion dollars annually just in the United States. Practitioners utilize various techniques and devices to remedy back pain. One common device utilized is a therapy table. Therapy tables are specialized tables that provide a surface that allows a practitioner to position and manipulate a user in order to deliver a treatment. Therapy tables often include features such as multi-directional head-pieces and motorized adjustment controls for executing downward movements.

One issue with conventional therapy tables is the lack of portability. Conventional therapy tables weigh hundreds of pounds and require operable coupling to a power source for operation. As a result, users must visit a practitioner at an office in order to receive therapeutic treatment. Other deficiencies include the inability for conventional tables to be adapted for exercise routines.

Accordingly, there is a need for a portable therapy table that provides a platform for treating a user and additionally functions to facilitate various exercise routines.

SUMMARY OF THE INVENTION

It is the object of the present invention to provide a portable therapy table configurable to provide a platform for treatment of a user that includes a user support surface wherein the user support surface includes a first portion and a second portion.

Another object of the present invention is to provide a therapy table that can be utilized to facilitate therapeutic treatment and exercise routines that includes a headpiece operably coupled to the first portion of the user support surface.

A further object of the present invention is to provide a portable therapy table that includes an extendable engagement member wherein the extendable engagement member is in axial alignment with the user support surface and extends outward from the therapy table beyond the headpiece.

Still another object of the present invention is to provide a therapy table that can be utilized to facilitate therapeutic treatment and exercise routines that further includes leg members wherein the leg members are configurable to releasably secure the legs of a user while superposed on the user support surface.

An additional object of the present invention is to provide a portable therapy table that includes leg members wherein the leg members are foldable.

Yet a further object of the present invention is to provide a portable therapy table configurable to provide a platform for treatment of a user wherein the second portion of the support surface is operable to move at an angle of approximately twenty-five degrees with respect to the first portion.

Another object of the present invention is to provide surface a portable therapy table wherein the rear leg members includes a piston configured to facilitate movement of the second portion of the support surface.

Still a further object of the present invention is to provide a portable therapy table configurable to provide a platform for treatment of a user that further includes an integrated power supply and controller for operation of the table.

Yet a further object of the present invention is to provide a portable therapy table wherein the extendable engagement includes an integrated actuator wherein the actuator is configured to provide operable control of the piston.

An alternative object of the present invention is to provide a portable therapy table having a frame that is manufactured from a lightweight material such as but not limited to aluminum.

A further object of the present invention is to provide a portable therapy table configurable to provide a platform for treatment of a user wherein the therapy table is configured to be foldable.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
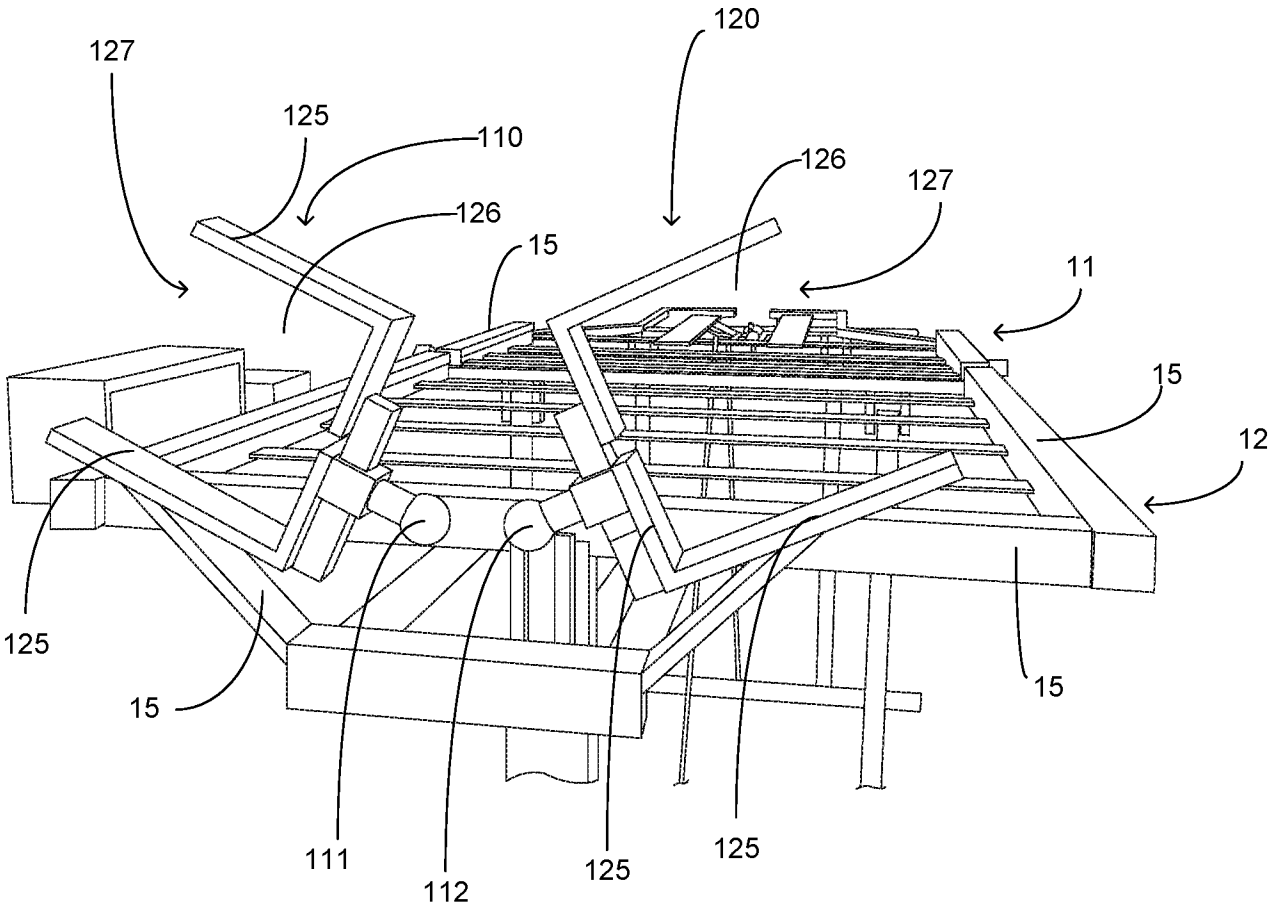
FIG. 1 is a rear end view of the frame of the present invention.

Referring now to the drawings submitted herewith, wherein various elements depicted therein are not necessarily drawn to scale and wherein through the views and figures like elements are referenced with identical reference numerals, there is illustrated a portable therapy table 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 2:
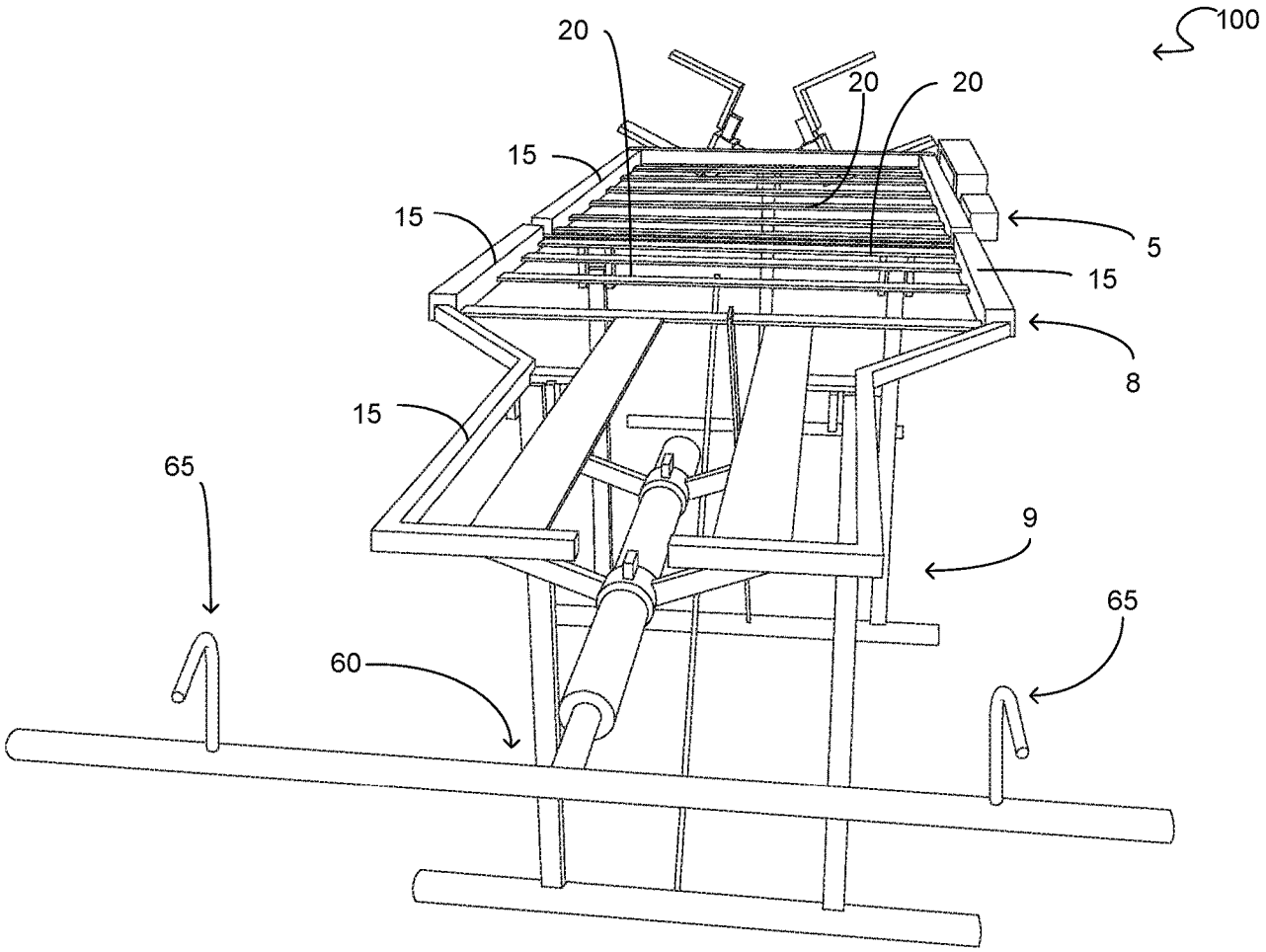
FIG. 2 is a front end view of the frame of the present invention.
Figure 3:
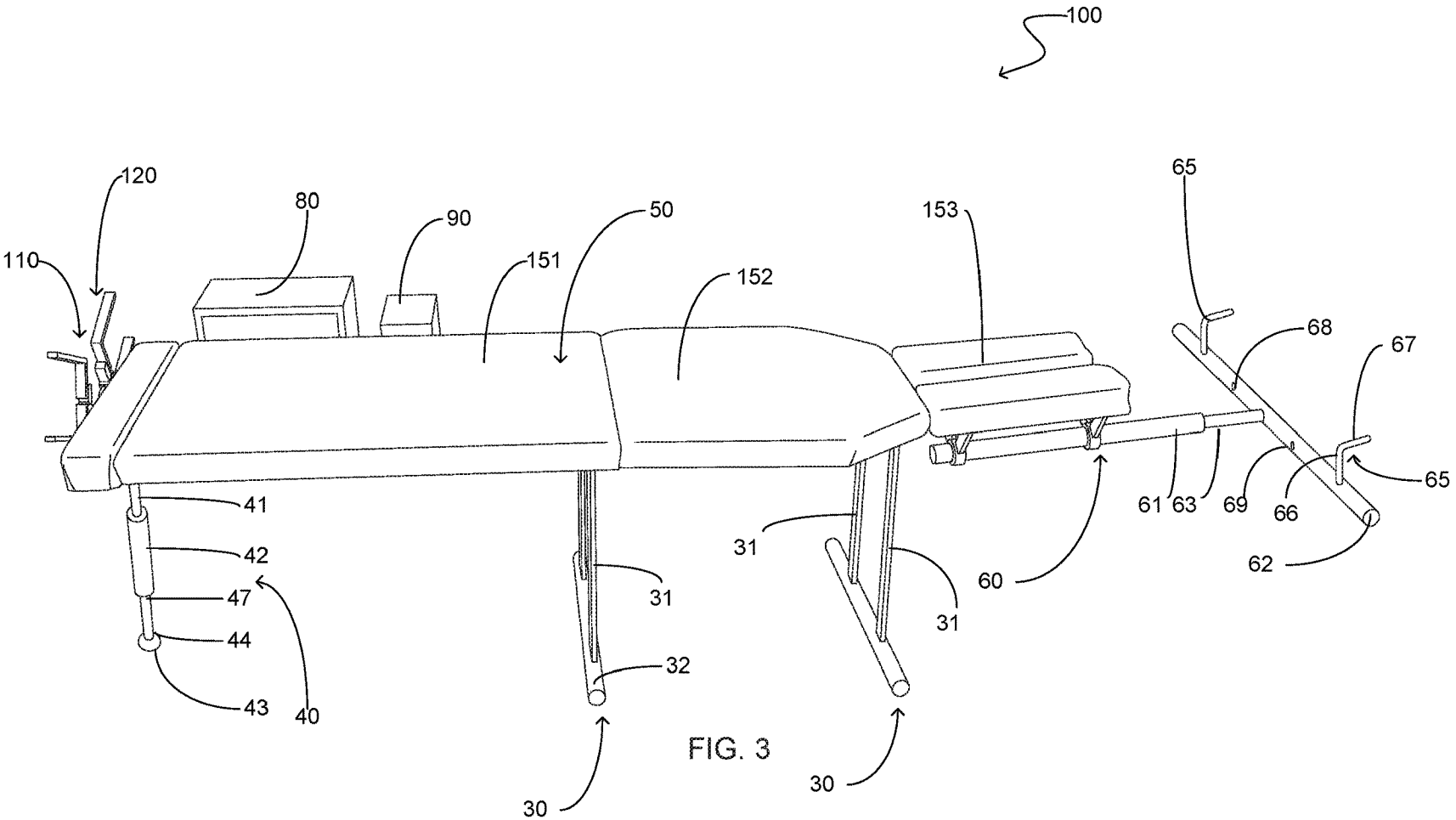
FIG. 3 is a side perspective view of the present invention.

Referring now to FIG. 1 and FIG. 2 submitted herewith, the portable therapy table 100 includes frame 5 having upper portion 8 and leg members 9. The frame 5 is configured to provide structural support for the portable therapy table 100 and is manufactured from a lightweight rigid material such as but not limited to aluminum. The frame 5 is hingedly secured intermediate the first portion 11 and second portion 12. It is contemplated within the scope of the present invention that the hinged coupling of the first portion 11 and second portion 12 could be facilitated by numerous conventional styles of hingeable fasteners. The hinged coupling of the first portion 11 and second portion 12 promotes the folding of the portable therapy table 100 so as to assist in the storage and transportation thereof. The frame 5 includes a plurality of peripheral structural members 15 that are manufactured from materials such as but not limited to square metal tubing. The peripheral structural members 15 define the shape of the portable therapy table 100 and it is contemplated by those skilled in the art that the peripheral structural members 15 could vary in quantity and form alternate shapes to those illustrated herein. A plurality of cross-members 20 extend intermediate opposite peripheral structural members 15 and are perpendicular thereto. The cross-members 20 provide the necessary support for the user support surface 50. The user support surface 50 is a conventional padded material and includes a lower section 151, upper section 152 and head section 153. It is contemplated within the scope of the present invention that the frame 5 could employ various quantities of cross-members 20 in the construction thereof as needed for parameters such as but not limited to weight and user support requirements.

The frame 5 includes forward leg members 30 and rear leg member 40. Forward leg members 30 include vertical support members 31 and horizontal support members 32 wherein the horizontal support members 32 and secured to the vertical support members 31 and are perpendicular thereto. The forward leg members 30 are foldably secured to the frame 5 so as to assist in the folding and subsequent transportation of the portable therapy table 100. The horizontal support members 32 and vertical support members 31 are manufactured from a rigid lightweight material such as but not limited to aluminum. While a particular configuration has been illustrated and discussed herein for the forward leg members 30, it is contemplated within the scope of the present invention that the alternate configurations of the forward leg members 30 could be constructed in order to achieve the desired objective.

Secured to the first portion 11 of the frame 5 and extending outward therefrom is the extendable engagement member 60. The extendable engagement member 60 is in general axial alignment with the first portion 11 of the frame 5 and includes lower section 61 and upper section 62. The lower section 61 is configured to be telescopic so as to place the upper section 62 is a desired position for user's of alternate heights and/or arm lengths. It is contemplated within the scope of the present invention that the lower section 61 could be constructed with various components and/or techniques in order to achieve the desired functionality of being telescopic. The lower section 61 further includes a foldable section 63. Foldable section 63 is operable to facilitate the desired position of the extendable engagement member 60 when the portable therapy table 100 is place in its folded position for transportation thereof. While a particular structure of the extendible engagement member 60 has been illustrated and discussed herein, it is contemplated within the scope of the present invention that the portable therapy table 100 could have more than one extendable engagement member 60 an extendable engagement member 60 is present on opposing sides of the first portion. Configurations of the portable therapy table 100 having a single extendable engagement member 60 it is preferred as illustrated herein to have the extendable engagement member 60 longitudinally central so as to be in general alignment with a user's spine. It is further contemplated within the scope of the present invention that the extendable engagement member 60 further includes a hinge or similar element that facilitate the positioning of the upper section 62 such that the upper section 62 is perpendicular to the lower section 61 and extending upwards with respect thereto. The aforementioned configuration would facilitate improved engagement by a user when a user is superposed on their back.

Figure 4:
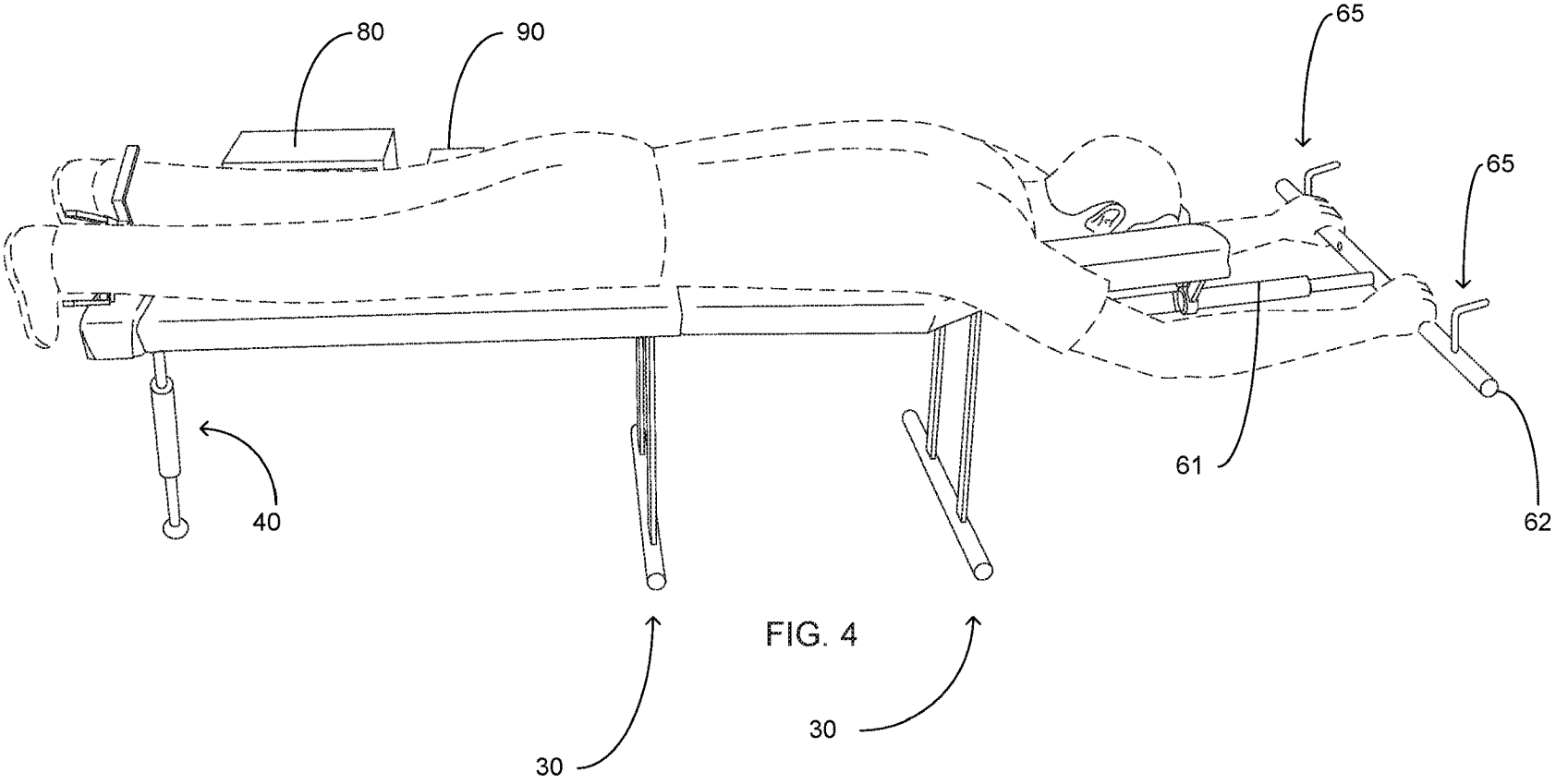
FIG. 4 is a side perspective view of the present invention with an exemplary user superposed thereon.

Upper section 62 is secured to lower section 61 utilizing suitable durable techniques and is perpendicular thereto. The upper section 62 provides a gripping element for a user as illustrated herein in particular in FIG. 4. The upper section 62 is manufactured from a durable rigid material and has formed thereon keepers 65. The upper section 62 further includes actuators 68,69. The keepers 65 are secured to the top of the upper section 62 and include a first section 66 and a second section 67. The first section 66 of the keeper 65 extends upward from the upper section 62. The second section 67 of the keeper 65 extends perpendicularly outward from the first section 66. The keepers 65 are configured so as to have an element such as but not limited to a rubber exercise band releasably secured thereto. The portable therapy table 100 is utilized by a user in various positions wherein in some positions it is desirable to utilize rubber exercise bands or a similar resistance element. The structure of the keepers 65 provide a technique to releasably secure the rubber exercise bands thereto. While a particular structure of the keepers 65 has been described and illustrated herein, it is contemplated within the scope of the present invention that the keepers 65 could be constructed in alternate manners and achieve the desired objective stated herein.

Secured to the peripheral structural members 15 are the power supply 80 and controller 90. The power supply 80 is a conventional power supply that is electrically coupled to the controller 90 utilizing conventional techniques. The power supply 80 is operable to provide the necessary power required as discussed herein to operate the portable therapy table 100. It is contemplated within the scope of the present invention that the power supply 80 is a lithium ion battery but it should be understood that alternate battery types and/or power sources could be utilized. By way of example but not limitation, it is further contemplated within the scope of the present invention that the portable therapy table 100 could be configured so as to plug into a conventional one hundred and twenty volt electrical receptacle. The controller 90 contains the necessary electronics to receive, store, transmit and manipulate data. The controller 90 provides overall operational control for the portable therapy table 100 and is operably coupled to the actuators 68,69 and the rear leg member 40 as will be further discussed herein.

The portable therapy table 100 includes rear leg member 40 that is secured to the second portion 12 of the frame 5. The rear leg member 40 is configured to facilitate the downward movement of the second portion 12 relative to the first portion 11. The rear leg member 40 includes a housing 42 and piston rod 41 wherein the piston rod 41 is movable with respect to the housing 42 so as to facilitate the movement of the second portion 12. Secured to the housing 42 opposite the piston rod 41 is support member 47. Support member 47 is hingedly secured to base 43. The hingable coupling of support member 47 to base 43 is at joint 44. The aforementioned configuration provides the ability for the base 43 to remain completely intact with the ground on which the portable therapy table 100 is superposed so as to ensure a stable engagement therewith. It is contemplated within the scope of the present invention that the rear leg member 40 could be configured as an air or fluid piston. The rear leg member 40 is operably coupled to the controller 90. In order to facilitate the movement of the rear leg member 40 a user will engage the actuators 68,69. Depression of the actuators 68,69 will move the rear leg member 40 such that the second portion 12 will move at a downward angle respective to the first portion 11. It is desired within the scope of the present invention that the second portion 12 is operable to move intermediate approximately zero to twenty five degrees with respect to the first portion 11. It is further contemplated within the scope of the present invention that the movement of the second portion 12 occurs in degree ranges from one degree to five degrees wherein a user can program the desired range with the controller 90. It is additionally contemplated within the scope of the present invention that the downward movement of the second portion 12 could be continuous in addition to the incremental movement discussed herein. The incremental or the continuous movements of the second portion can either be pre-programmed or controlled by the user utilizing the actuators 68,69 to initiate the continuous or incremental movement. While integrated actuators 68,69 are discussed and illustrated herein to facilitate the movement of the rear leg member 40, it is contemplated within the scope of the present invention that the rear leg member 40 could be controlled utilizing alternate techniques. It is further contemplated within the scope of the present invention that the portable therapy table 100 could have more than one rear leg member 40 constructed similarly to the rear leg member 40 described herein.

Secured to the second portion 12 distal to the first portion 11 are leg members 110,120. Leg members 110, 120 are configured to releasably secure to the legs of a user as illustrated herein in FIG. 4. The leg members 110, 120 are rotatably mounted to the second portion 12 via attachment members 111,112 respectively. The attachment members 111,112 provide the rotational movement necessary to facilitate the ability secure a user's legs while in use and provide a technique to release ensuing utilization of the portable therapy table 100. The leg members 110,120 are identically constructed having a plurality of contiguous members 125 configured to form a void 126 suitably sized to accommodate a portion of a leg therein. Members 125 are movably mounted in order to provide alteration of the size of the void 126. Members 125 are movable in an inward-outward movement so as to control the size of the void 126 in order to provide a size thereof for releasably securing a portion of different user's legs that may vary in size. An opening 127 is present providing access to the void 126. While a particular configuration of the leg members 110,120 are illustrated and discussed herein, it is contemplated within the scope of the present invention that the leg members 110,120 could be constructed utilizing alternate techniques and still achieve the desired objective.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A portable therapy table configured to provide a downward movement for a user superposed thereon, said portable therapy table comprising:

a frame, said frame being constructed from a rigid lightweight material, said frame including a first portion and a second portion, said frame including a plurality of peripheral structural members configured to define the exterior shape of said frame, said first portion and said second portion being hingedly secured, said second portion hingedly coupled to said first portion and configured to hinge downward up to an angle of approximately twenty five degrees with respect to said first portion, said frame further include a headpiece, said headpiece secured to said first portion opposite said second portion;

a user support surface, said user support surface being superposed said frame, said user support surface being manufactured from a padded material, said user support surface including a lower section and an upper section;

an extendable engagement member, said extendable engagement member being secured to said first portion of said frame and extending outward therefrom, said extendable engagement member being longitudinally centralized to said frame, said extendable engagement member having a lower section and an upper section, said upper section of said extendable engagement member being perpendicular to said lower section of said extendable engagement member;

a controller secured to said frame, said controller having the necessary electronics to receive, store, transmit and manipulate data;

at least two forward leg members, said at least two forward leg members foldably mounted to said frame, said at least two forward leg members having vertical support members and horizontal support members;

a rear leg member, said rear leg member operably coupled to said second portion of said frame distal to said first portion of said frame, said rear leg member operably coupled to said controller, said rear leg member being movable in an upwards-downwards direction;

at least one actuator, said at least one actuator mounted to said upper section of said extendable engagement member, said at least one actuator operably coupled to said controller, said at least one actuator configured to provide control of the rear leg member so as to facilitate the hinged movement of the second portion of said frame relative to said first portion of said frame.

2. The portable therapy table as recited in claim 1, wherein said second portion of said frame is configured to move in a movement selected from one of the following: continuous or incremental.

3. The portable therapy table as recited in claim 1, wherein said rear leg member further includes a housing, said housing having an upper end and a lower end, said rear leg member having a piston rod movably coupled to said housing at said upper end.

4. The portable therapy table as recited in claim 3, and further including at least one keeper, said at least one keeper being secured to said upper section of said extendable engagement member, said at least one keeper having a first portion and a second portion, said at least one keeper extending upward from said upper section of said extendable engagement member.

5. The portable therapy table as recited in claim 4, wherein said rear leg member further includes a support member, said support member secured to the lower end of said housing, said support member having coupled thereto a base member, said base member being secured to said support member distal to said housing.

6. The portable therapy table as recited in claim 5, and further including a pair of leg members, said leg members being rotatably mounted to said second portion of said frame distal to said first portion, said pair of leg members being comprised of a plurality of integrally formed members configured to form an opening and a void so as to releasably secure a user's legs therein.

7. The portable therapy table as recited in claim 6, wherein said frame further includes a plurality of cross members, said plurality of said cross members being intermediate said plurality of peripheral structural members and perpendicular thereto wherein the plurality of cross members are configured to provide support for said user support surface.

8. A portable therapy table that is configured to have a folded position and a deployed position wherein in the deployed position the portable therapy table is operable to facilitate a downward movement for a user superposed thereon said portable therapy table comprising:

a frame, said frame being constructed from a rigid lightweight material, said frame including a first portion and a second portion, said frame including a plurality of peripheral structural members configured to define the exterior shape of said frame, said first portion and said second portion being hingedly secured, said second portion hingedly coupled to said first portion and configured to hinge downward up to an angle of approximately twenty five degrees with respect to said first portion, said frame further include a headpiece, said headpiece secured to said first portion opposite said second portion;

a user support surface, said user support surface being superposed said frame, said user support surface being manufactured from a padded material, said user support surface including a lower section and an upper section;

an extendable engagement member, said extendable engagement member being secured to said first portion of said frame and extending outward therefrom, said extendable engagement member being longitudinally centralized to said frame, said extendable engagement member having a lower section and an upper section, said upper section of said extendable engagement member being perpendicular to said lower section of said extendable engagement member, said upper section of said extendable engagement member forming a t-shape with said lower section of said extendable engagement member;

a controller secured to said frame, said controller having the necessary electronics to receive, store, transmit and manipulate data;

at least two forward leg members, said at least two forward leg members foldably mounted to said frame, said at least two forward leg members having vertical support members and horizontal support members;

a rear leg member, said rear leg member operably coupled to said second portion of said frame distal to said first portion of said frame, said rear leg member further includes a housing, said housing having an upper end and a lower end, said rear leg member having a piston rod movably coupled to said housing at said upper end, said rear leg member further including a support member, said support member secured to the lower end of said housing, said support member having coupled thereto a base member, said base member being secured to said support member distal to said housing, said rear leg member operably coupled to said controller, said rear leg member operable to facilitate the movement of said second portion of said frame;

at least one actuator, said at least one actuator mounted to said upper section of said extendable engagement member, said at least one actuator operably coupled to said controller, said at least one actuator configured to provide control of the rear leg member so as to facilitate the hinged movement of the second portion of said frame relative to said first portion of said frame.

9. The portable therapy table as recited in claim 8, and further including a pair of keepers, said pair of keepers being secured to said upper section of said extendable engagement member proximate opposing ends thereof, said pair of keepers having a first portion and a second portion, said first portion of said pair of keepers extending upward from said upper section of said extendable engagement member, said second portion of said pair of keepers being perpendicular to said first portion of said pair of keepers and distal to said upper section of said extendable engagement member.

10. The portable therapy table as recited in claim 9, and further including a pair of leg members, said leg members being rotatably mounted to said second portion of said frame distal to said first portion, said pair of leg members being comprised of a plurality of integrally formed members configured to form an opening and a void so as to releasably secure a user's legs therein.

11. The portable therapy table as recited in claim 10, wherein said second portion of said frame is configured to move in a downward direction with a movement selected from a group of one of the following types of movements: continuous or incremental.

12. The portable therapy table as recited in claim 11, wherein said extendable engagement member is in axial alignment with said frame.

13. The portable therapy table as recited in claim 12, wherein said support member of said rear leg member is hingedly secured to said base member so as to facilitate engagement of said base member with a floor on which the portable therapy table is superposed.

* * * * *